US012662277B2

(12) United States Patent
Duncan

(10) Patent No.: US 12,662,277 B2
(45) Date of Patent: Jun. 23, 2026

(54) STEAM HEATED SHRINK TUNNEL

(71) Applicant: Axon LLC, Raleigh, NC (US)

(72) Inventor: Adam W. Duncan, Apex, NC (US)

(73) Assignee: AXON LLC, Raleigh, NC (US)

( * ) Notice: Subject to any disclaimer, the term of this patent is extended or adjusted under 35 U.S.C. 154(b) by 92 days.

(21) Appl. No.: 18/155,401

(22) Filed: Jan. 17, 2023

(65) Prior Publication Data

US 2023/0242296 A1 Aug. 3, 2023

Related U.S. Application Data

(60) Provisional application No. 63/305,401, filed on Feb. 1, 2022.

(51) Int. Cl.
*B65B 53/06* (2006.01)
*B65B 59/00* (2006.01)

(52) U.S. Cl.
CPC ..... *B65B 53/063* (2013.01); *B65B 59/003* (2019.05)

(58) Field of Classification Search
CPC ..... B65B 59/003; B65B 53/063; B65B 53/04; B65B 53/06; B65B 35/24; B65B 21/245; B65B 35/44; B65B 53/02; B65B 53/00; B29C 63/423; B29C 35/049
See application file for complete search history.

(56) References Cited

U.S. PATENT DOCUMENTS 2,829,791 A 4/1958 Berst
3,357,153 A * 12/1967 Shaffer ..... B65B 53/063 53/442
3,678,244 A 7/1972 Worline
3,750,303 A 8/1973 Gates
3,756,769 A 9/1973 Richardson
4,738,082 A 4/1988 Saitoh
5,062,217 A 11/1991 Tolson
5,189,948 A 3/1993 Liebermann
5,400,570 A 3/1995 Bennett
6,576,872 B2 6/2003 Bertero
6,958,178 B2 10/2005 Hayakawa
8,235,712 B1 * 8/2012 Lewis ..... B65D 23/0878 432/143
2009/0188605 A1 * 7/2009 Huang ..... B29C 61/00 156/499
2016/0001908 A1 * 1/2016 Schilling ..... B65B 35/44 53/442
2021/0292023 A1 * 9/2021 Uetsuki ..... B65B 53/063

* cited by examiner

*Primary Examiner* — Veronica Martin
(74) *Attorney, Agent, or Firm* — THOMPSON HINE LLP

(57) ABSTRACT

An apparatus for shrinking film onto products moving along a conveyance path includes an elongated steam chamber shaped to form a shrink tunnel through which the conveyance path extends, wherein tunnel side surface portions of the elongated steam chamber bound the path at least in tunnel regions above a plane of the conveyance path and the tunnel side surface portions are heated by steam within the elongated steam chamber and the tunnel side surface portions thereby radiate heat into the shrink tunnel. At least one steam header is positioned within the shrink tunnel and extending along at least part of a length of the shrink tunnel, the steam header including a plurality of steam ejection orifices for ejecting steam into the shrink tunnel. At least one steam flow path feeds steam from an output of the elongated steam chamber to an input of the at least one steam header.

17 Claims, 6 Drawing Sheets

STEAM HEATED SHRINK TUNNEL

TECHNICAL FIELD

This application relates generally to methods and apparatus for shrinking of a heat shrinkable film about a product, and more particularly to a heat shrink steam tunnel and method for shrinking heat shrinkable film, such as tubular sleeves, about containers, such as cans or bottles.

BACKGROUND

Heat shrinkable film is commonly applied to containers, such as bottles or cans, which are thereafter passed through some heating zone to shrink the film into close contact with the containers. One form of known heating zone for such purposes is a shrink tunnel, where a conveyor carries the containers through the shrink tunnel. Various heating technologies have been used in such shrink tunnel, such radiant heater elements and/or steam ejection into the tunnel. Shrink tunnels that utilize steam can suffer from undesired condensation within the tunnel, causing moisture to fall onto the containers, which is undesirable, particularly in the case of containers that are not sealed (e.g., empty cans or bottles that have not yet been filled). In addition, the ability to easily control the direction of flow of steam in the tunnel is problematic.

It would be desirable to provide a heat shrinking steam tunnel that addresses the condensation problem and/or the flow direction problem in an efficient and effective manner

SUMMARY

In one aspect, an apparatus for shrinking film onto products moving along a conveyance path includes an elongated steam chamber shaped to form a shrink tunnel through which the conveyance path extends, wherein tunnel side surface portions of the elongated steam chamber bound the path at least in tunnel regions above a plane of the conveyance path and the tunnel side surface portions are heated by steam within the elongated steam chamber and the tunnel side surface portions thereby radiate heat into the shrink tunnel. At least one steam header is positioned within the shrink tunnel and extending along at least part of a length of the shrink tunnel, the steam header including a plurality of steam ejection orifices for ejecting steam into the shrink tunnel. At least one steam flow path feeds steam from an output of the elongated steam chamber to an input of the at least one steam header.

In another aspect, an apparatus for shrinking film onto products moving along a conveyance path includes an elongated steam chamber shaped to form a shrink tunnel through which the conveyance path extends, wherein a plurality of tunnel facing walls of the elongated steam chamber are heated by steam within the elongated steam chamber and the plurality of tunnel facing walls thereby radiate heat into the shrink tunnel.

In a further aspect, an apparatus shrinking film onto products moving along a conveyance path includes an elongated shrink tunnel through which the conveyance path extends. At least one steam pipe is positioned within the shrink tunnel and extending along at least part of a length of the shrink tunnel, the steam pipe including a plurality of steam ejection orifices for ejecting steam into the shrink tunnel. The at least one steam pipe is mounted to permit tool-free rotation for adjusting a directional output of the steam injection orifices.

In yet another aspect, a method for heat shrinking tubular film onto containers, involves: conveying a container with tubular film thereon through a shrink tunnel formed by an elongated steam chamber; applying radiant heat into the shrink tunnel via tunnel facing walls of the elongated steam chamber; and applying steam heat into the shrink tunnel via ejection of steam from multiple orifices located within the shrink tunnel, wherein the ejected steam traverses through the elongated steam chamber before being delivered to the steam orifices.

The details of one or more embodiments are set forth in the accompanying drawings and the description below. Other features, objects, and advantages will be apparent from the description and drawings, and from the claims.

DETAILED DESCRIPTION

Figure 1:
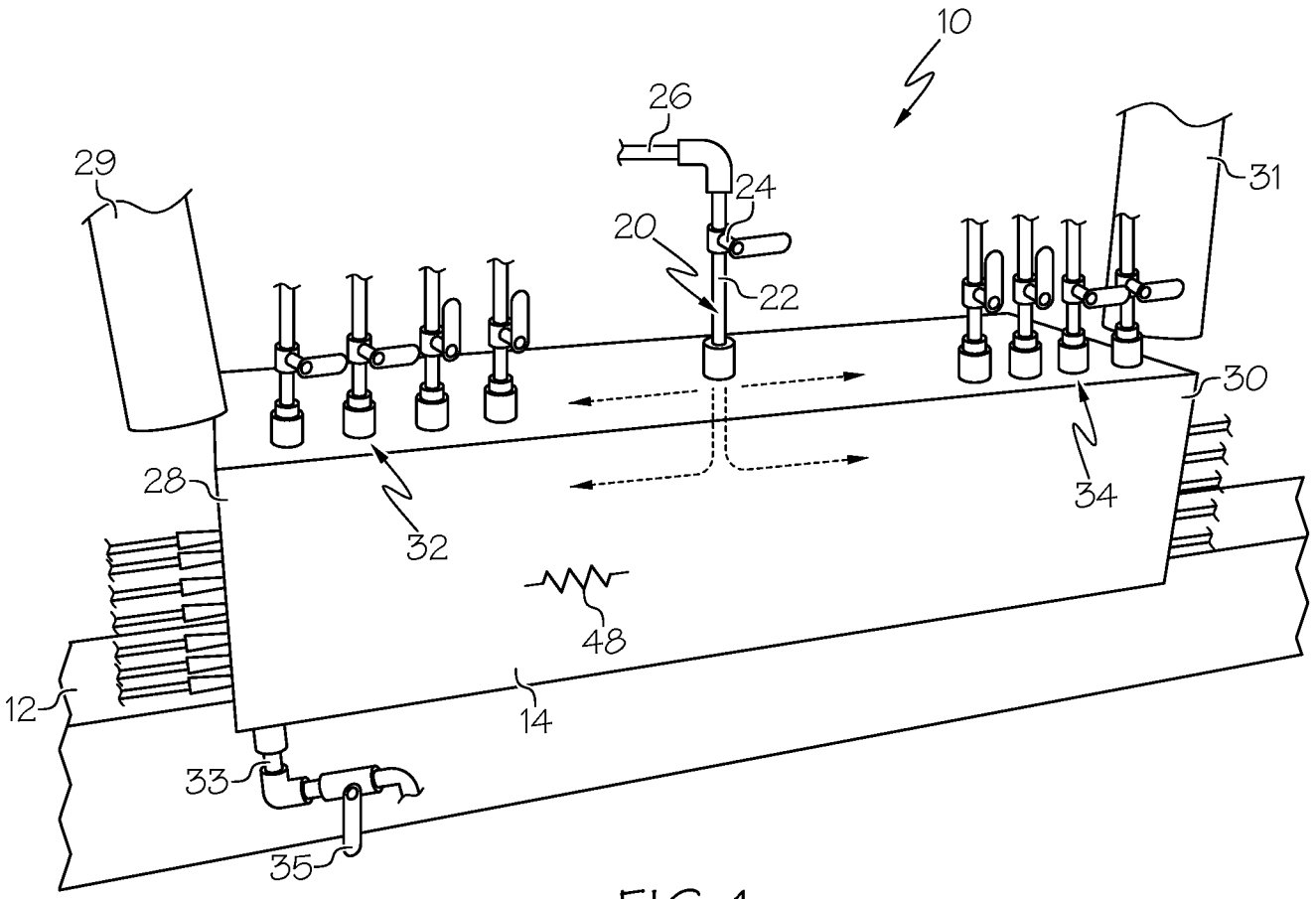
FIG. 1 is a perspective view of a shrink tunnel apparatus.
Figure 2:
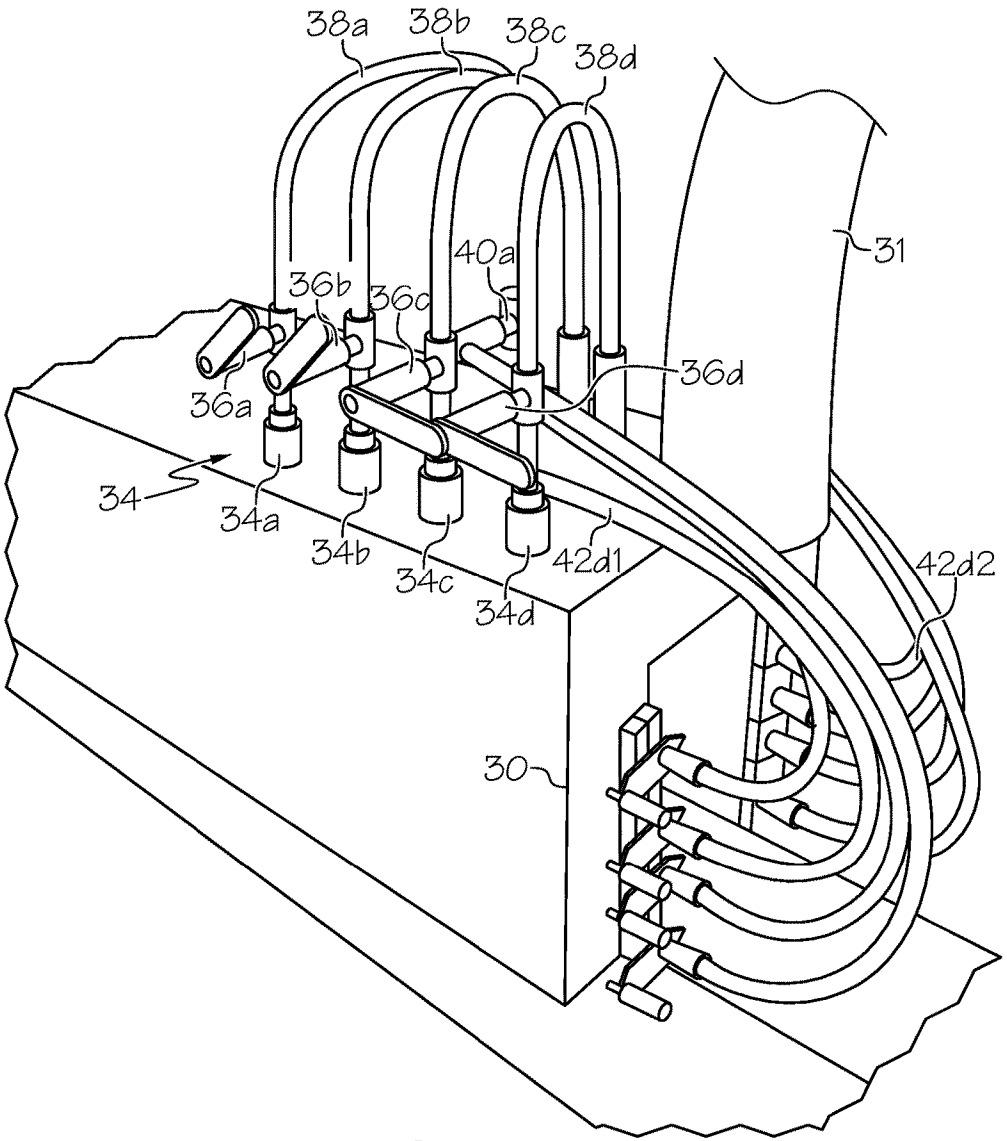
FIG. 2 is a perspective view of on end of the shrink tunnel apparatus.
Figure 3:
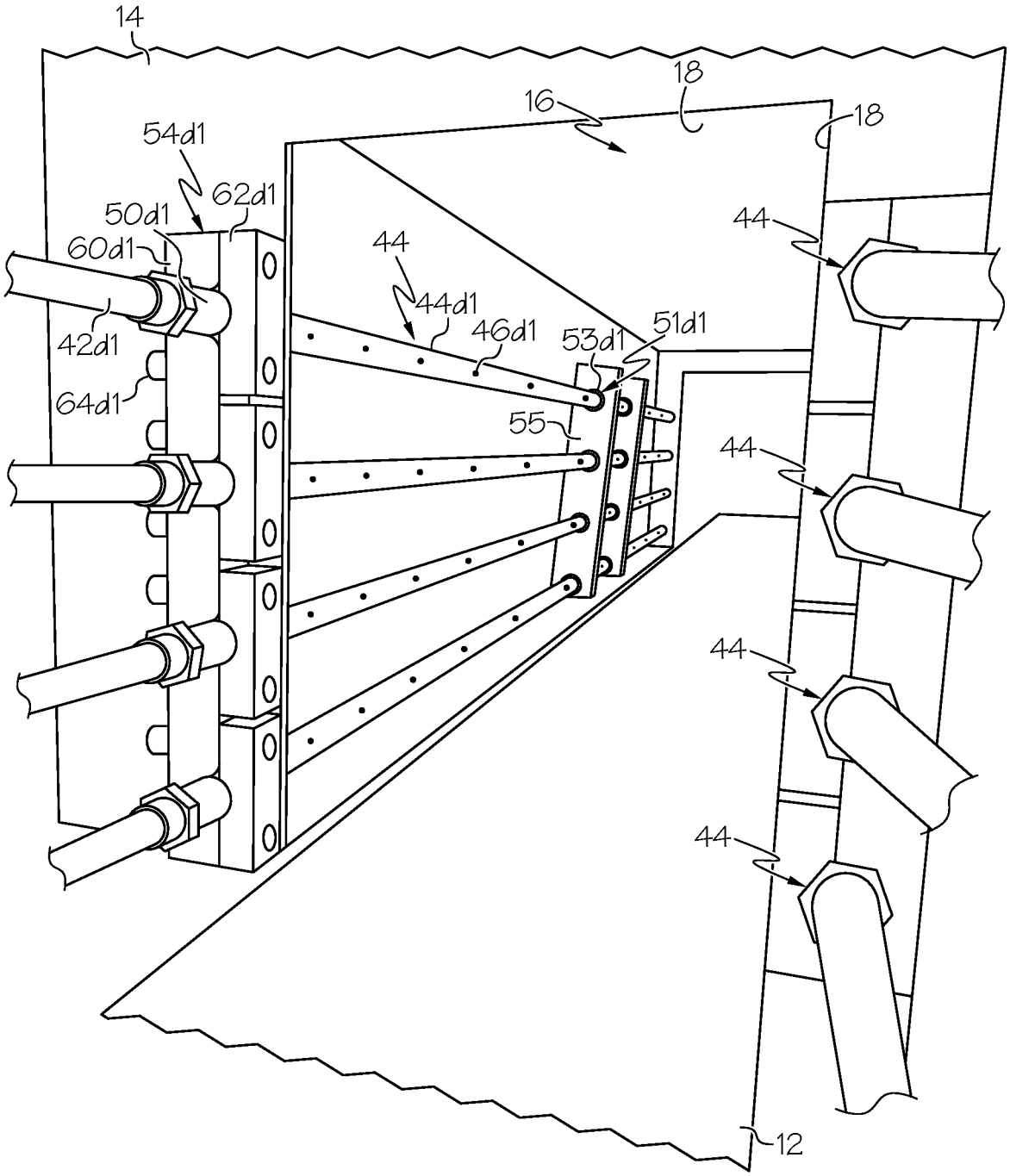
FIG. 3 is a perspective view into the end of the shrink tunnel apparatus.
Figure 4:
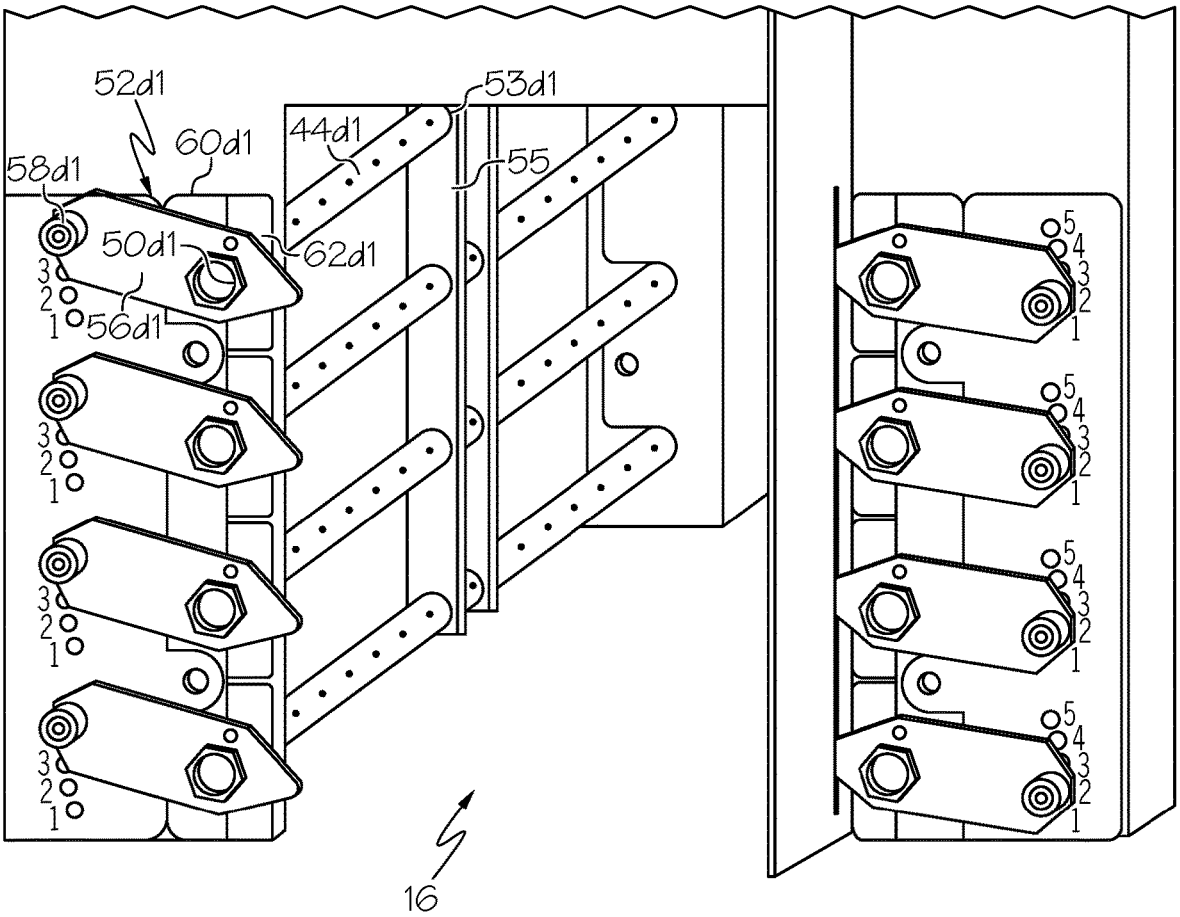
FIG. 4 is a perspective view of the end of the shrink tunnel apparatus.
Figure 5:
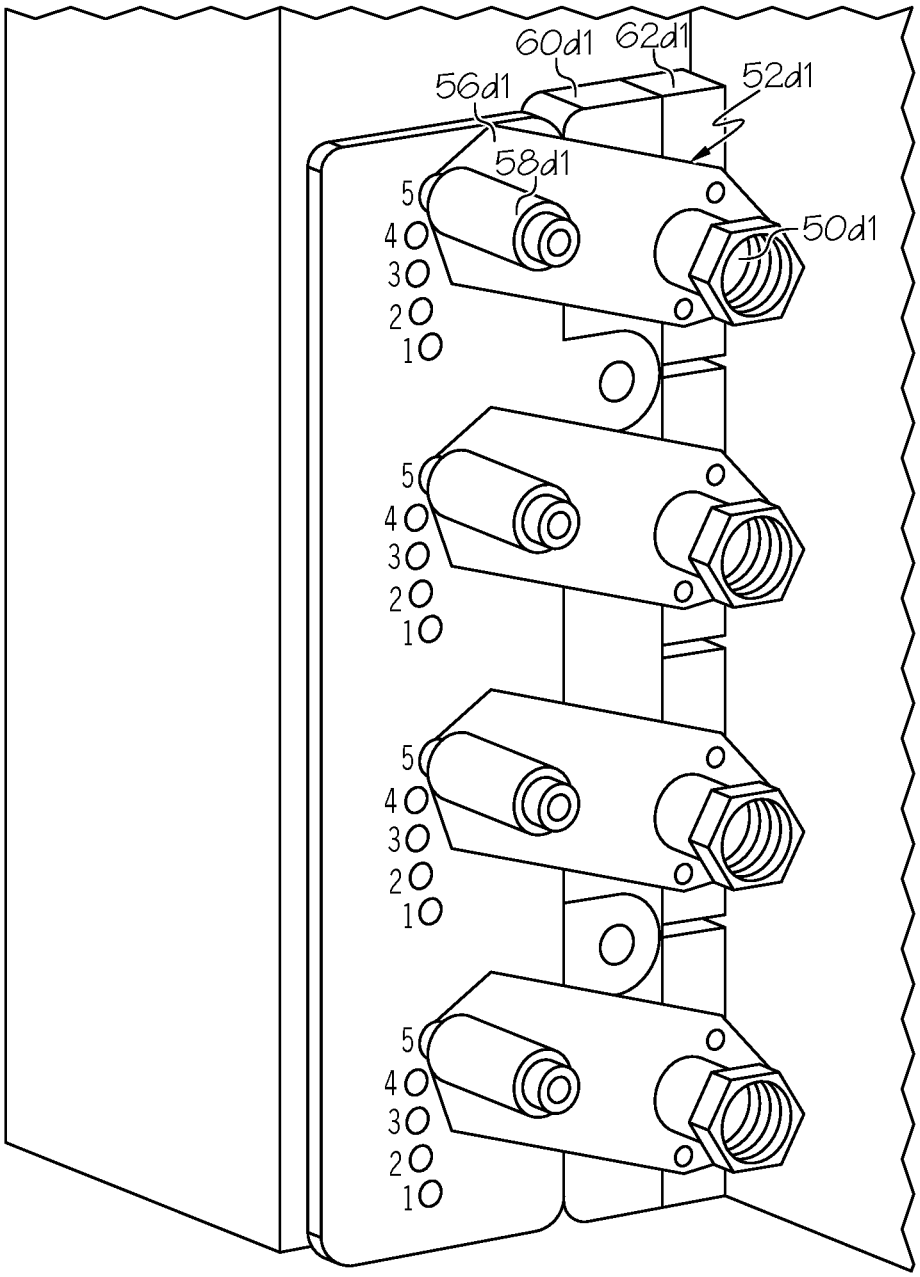
FIG. 5 is a perspective view of the end of the shrink tunnel apparatus.
Figure 6:
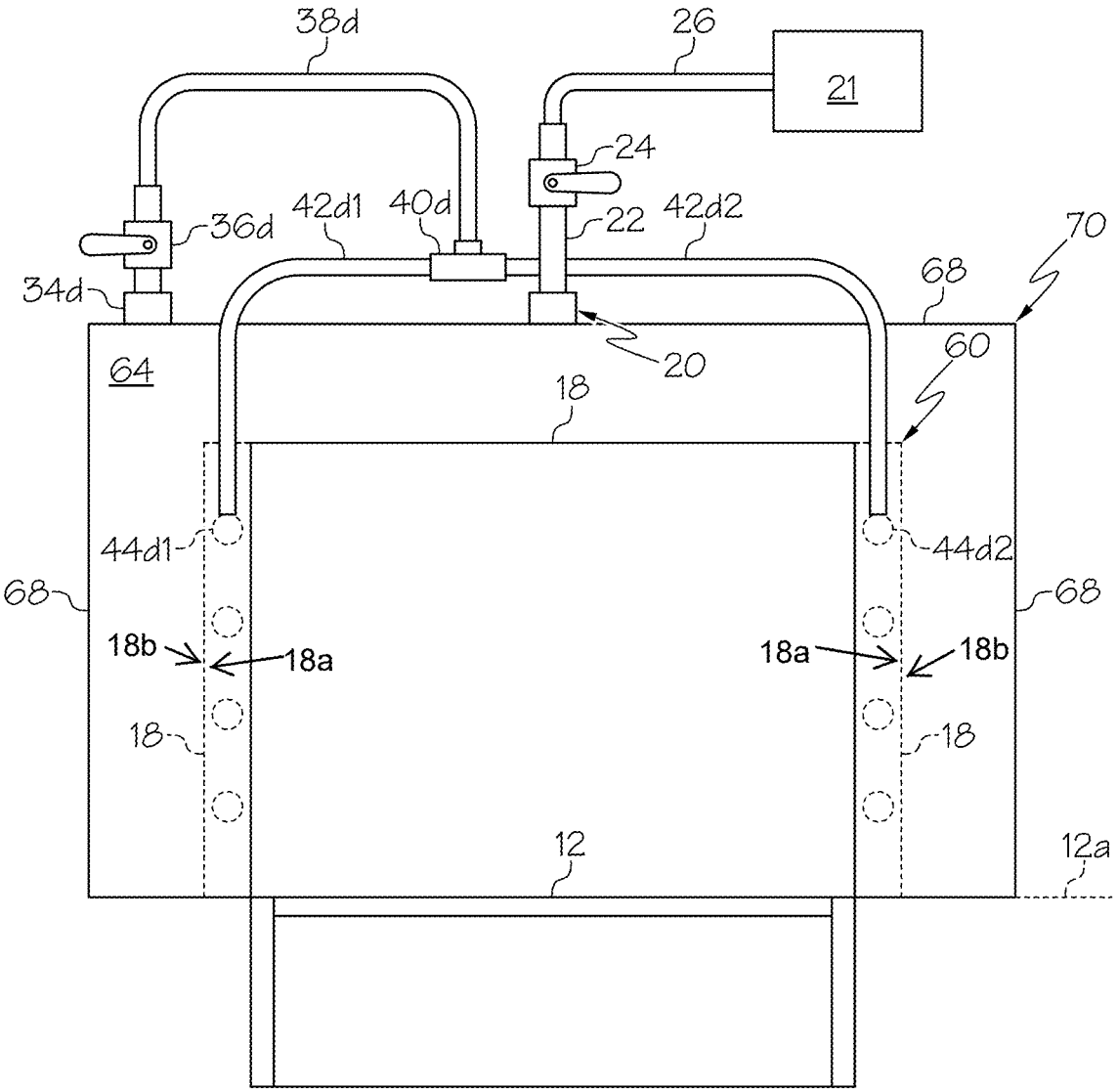
FIG. 6 is a schematic end profile view depicting the shrink tunnel and the steam chamber.

Referring to FIGS. 1-6, an apparatus 10 is provided for shrinking film onto products moving along a conveyance path 12. The apparatus includes an elongated steam chamber 14 shaped to form a shrink tunnel 16 through which the conveyance path 12 extends. The chamber 14 includes internal, tunnel facing walls 18 (e.g., top and side walls) that form tunnel side surface portions of the elongated steam chamber that at least partly bound the path 12, at least in tunnel regions above a plane 12*a* of the conveyance path, and, here in tunnel regions alongside the conveyance path. The tunnel facing walls 18 include inner surfaces 18*a* facing and exposed to the shrink tunnel and outer surfaces 18*b* facing and exposed to the interior steam flow space 64. Notably, the interior steam flow space 64 of the elongated steam chamber 14 is a volume that is separated from the tunnel 16 by walls 18 that define the elongated steam chamber. The elongated steam chamber 14 includes a steam input 20, here formed by a centrally located upward extending pipe 22 with an associated manual flow control valve 24. A steam feed tube 26 feeds steam from a boiler 21 to the steam input 20. Once the steam enters the interior steam flow space 64 of the chamber 14, the steam can flow toward opposite ends 28, 30 of the chamber and, while doing so, flow over and in contact with the inner surfaces 18*a* to heat the tunnel facing walls 18. Each end 28, 30 includes a respective set of steam outlets 32, 34 from which steam exits the steam chamber to be delivered to steam ejection devices in the shrink tunnel 16.

Hear, at the external side of each end 28, 30 of the elongated steam chamber a steam take-up/exhaust tube 29, 31 is provided at the respective tunnel entrance/exit for reducing steam spillover from the tunnel 16 into the room in which the apparatus is located. In addition, the steam chamber 14 also includes a drain outlet 33 with associate manual valve 35.

Referring specifically to the steam outlets 32, 34, and by exemplary reference to only steam outlets 34, here four steam outlets 34*a*-34*d* are provided at each end. Each outlet

34*a*-34*d* includes an outlet fitting with an associated manual flow control valve 36*a*-36*d*. A respective feed tube 38*a*-38*d* from each flow control valve leads to a respective T-fitting (e.g., 40*a*, 40*d*) to split steam flow into two paths that feed to respective flexible tubes (e.g., 42*d*1 and 42*d*1). Each flexible tube connects to the input end of a respective steam header where, here, the steam headers are formed by copper steam pipes 44 (e.g., 44*d*1, 44*d*2) that extend internally along at least part of a length of the shrink tunnel 16. Each steam pipe includes a plurality of orifices (e.g., 46*d*1) thereon, spaced apart along the pipe length, for ejecting steam into the shrink tunnel 16. Thus, the feed tubes 38*a*-38*d*, T-fittings (e.g., 40*a*, 40*d*) and flexible tubes form multiple steam flow paths to deliver steam from the outputs of the steam chamber 14 to the inputs of the steam pipes. In the illustrated embodiment, eight steam outlets from the steam chamber are provided (four outlets at each end), and each steam outlet of the steam chamber delivers steam to two different steam pipes that are mounted on opposite sides of the shrink tunnel at substantially the same height. This configuration results in sixteen steam ejection pipes within the shrink tunnel, with eight steam pipes extending into the shrink tunnel at each end of the shrink tunnel. However, variations in the number of outlets and/or number of steam pipes are possible and contemplated. Notably, each of the valves 36*a*-36*d* enables the amount of steam that is delivered to the respective steam pipes to be adjusted based upon the dimensions (e.g., height) of the product and shrink film that is moving through the shrink tunnel.

Notably, the steam traveling through the steam chamber 14 will heat the tunnel facing walls 18, thereby causing the tunnel facing walls to radiate heat into the shrink tunnel 16. In embodiments, the tunnel facing walls 18 are maintained at 212° F. or higher (e.g., between 212° F. and 250° F.) during shrink operations, which reduces condensation within the shrink tunnel 16 and further enhances shrink of film. By way of example, a pressure of 10 psi or higher may be maintained within the elongated steam chamber 14. However, pressures within the full range of 1 psi to 80 psi are also contemplated.

In the above-described apparatus 10, the elongated steam chamber 14 functions as a steam manifold through which steam from the boiler progresses. The steam chamber 14 could also incorporate internal heating elements (e.g., 48) so as to act as a superheater for the steam during shrink operations.

In the illustrated embodiment, the steam pipes are mounted to permit tool-free rotation for adjusting a directional output of the steam injection orifices. Referring by way of example to steam pipe 44*d*1, the input end 50*d*1 is located externally of the shrink tunnel 16 and carries an adjustment handle 52*d*1 to enable manual rotation of the steam pipe 44*d*1. The interior end 51*d*1 of the steam pipe 44*d*1 is positioned in a bracket slot or opening (e.g., opening 53*d*1 in bracket 55) that is supportive but not limiting of pipe rotation. A clamp 54*d*1 frictionally engages the input end 50*d*1 of the steam pipe for inhibiting incidental rotation of the steam pipe, and a torque force applied via the handle 52*d*1 must exceed a frictional holding force of the clamp in order for the steam pipe to be rotated. Here, the handle 52*d*1 includes a bracket part 56*d*1 mounted to the input end of the pipe and rotatable grip 58*d*1 extending from the bracket part, but other variations are possible. In embodiments, the handle 54*d*1 could include a pin or detent member (e.g., ball detent) that is releasably engageable in openings (designated 1, 2, 3, 4, 5) to further assure the pipe position remains fixed once set for a given shrink operation. Here, the exemplary clamp 54*d*1 includes two clamp parts 60*d*1 and 62*d*1 that are secured together by one or more fasteners 64*d*1, where adjustment of the fastener(s) 64*d*1 enable adjustment of the frictional holding force against the external surface of the steam pipe.

In the illustrated embodiment, tunnel facing side walls 18 form an inverted U-shape 60 in end profile view or in view in cross-section taken in a plane perpendicular to the conveyance direction, to define the shrink tunnel 16, and the exterior side walls 68 also form an inverted U-shape 70, in end profile view or in view in cross-section taken in a plane perpendicular to the conveyance direction, that is spaced from and overlaps the inverted U-shape 60 to at least in part define an interior steam space 64 of the elongated steam chamber. Although not shown in FIG. 6, the interior steam space 64 could include baffling and/or heat exchange fins to enhance heat transfer to the tunnel facing walls 18.

The illustrated apparatus thus provides a method for heat shrinking tubular film onto containers, where the method involves: conveying a container with tubular film thereon through a shrink tunnel formed by an elongated steam chamber; applying radiant heat into the shrink tunnel via tunnel facing walls of the elongated steam chamber; and applying steam heat into the shrink tunnel via ejection of steam from multiple orifices located within the shrink tunnel, wherein the ejected steam traverses through the elongated steam chamber before being delivered to the steam orifices.

It is to be clearly understood that the above description is intended by way of illustration and example only, is not intended to be taken by way of limitation, and that other changes and modifications are possible.

What is claimed is:

1. An apparatus for shrinking film onto products moving along a conveyance path, comprising:

an elongated steam chamber shaped to form a shrink tunnel through which the conveyance path extends, wherein the elongated steam chamber includes spaced apart interior walls and exterior walls that define an interior steam flow space therebetween, wherein the interior walls define tunnel bounding wall portions that at least partly delimit the shrink tunnel at least in tunnel regions above a plane of the conveyance path, the tunnel bounding wall portions including inner surfaces facing and exposed to the shrink tunnel and outer surfaces facing and exposed to the interior steam flow space, wherein a steam input is provided for flowing steam into the interior steam flow space such that the steam fills the interior steam flow space, and the tunnel bounding wall portions are heated by steam flowing through the interior steam flow space over and in contact with the outer surfaces of the tunnel bounding wall portions, and the tunnel bounding wall portions thereby radiate heat into the shrink tunnel, an outlet from the interior steam flow space being formed in at least one of the exterior walls;

at least one steam header positioned within the shrink tunnel between the tunnel bounding wall portions and the conveyance path and extending along at least part of a length of the shrink tunnel, the at least one steam header including steam ejection orifices for ejecting steam into the shrink tunnel, the at least one steam header including a steam input located outside the shrink tunnel; and at least one steam flow tube running from the outlet, and outside of the shrink tunnel, for feeding steam from the outlet of the interior steam flow space to an input of the at least one steam header;

wherein the tunnel bounding wall portions include wall portions above the shrink tunnel and along side regions of the shrink tunnel.

2. The apparatus of claim 1, wherein the tunnel bounding wall portions of the elongated steam chamber are maintained at 212° F. or above during shrink operations.

3. The apparatus of claim 1, wherein a pressure within the interior steam flow space is maintained at 1 psi or above during shrink operations.

4. The apparatus of claim 1, wherein the interior steam flow space functions as a steam manifold through which steam progresses to reach the outlet.

5. The apparatus of claim 4, further comprising:

a steam boiler for heating water to produce steam, the steam boiler including an output that is connected to feed steam to the steam input.

6. The apparatus of claim 5, wherein the interior steam flow space includes multiple outlets, the at least one steam flow path comprises multiple steam flow paths, and the at least one steam header comprises multiple steam headers running along side portions of the shrink tunnel.

7. The apparatus of claim 1, wherein the at least one steam header is formed by at least one steam pipe positioned at least partly within the shrink tunnel, wherein the at least one steam pipe is mounted to permit tool-free rotation for adjusting a directional output of the steam injection orifices.

8. The apparatus of claim 7, wherein the at least one steam flow path comprises a flexible tubing that is connected to an input end of the at least one steam pipe, wherein the input end of the at least one steam pipe is positioned externally of the shrink tunnel and carries an adjustment handle to enable manual rotation of the at least one steam pipe.

9. The apparatus of claim 8, wherein a clamp frictionally engages the input end of the at least one steam pipe for inhibiting incidental rotation of the at least one steam pipe, and a torque force applied via the handle must exceed a frictional holding force of the clamp in order for the at least one steam pipe to be rotated.

10. The apparatus of claim 1, wherein the elongated steam chamber includes at least one heating element positioned within the interior steam flow space for heating steam within the interior steam flow space such that the elongated steam chamber functions as a superheater during shrink operations.

11. The apparatus of claim 1, wherein the interior walls form a first inverted U-shape to define the shrink tunnel, wherein the exterior walls form a second inverted U-shape that is spaced from and overlaps the first inverted U-shape to at least in part define the interior steam flow space of the elongated steam chamber.

12. An apparatus for shrinking film onto products moving along a conveyance path, comprising:

an elongated steam chamber including an interior steam flow space along which steam travels, wherein the elongated steam chamber is shaped to form a shrink tunnel through which the conveyance path extends, wherein the elongated steam chamber includes tunnel facing walls that separate the interior steam flow space from the shrink tunnel, wherein the tunnel facing walls include inner surfaces facing and exposed to the shrink tunnel and outer surfaces facing and exposed to the interior steam flow space, wherein a steam input is provided for flowing steam into the interior steam flow space, wherein steam traveling within the interior steam flow space and in contact with the outer surfaces of the tunnel facing walls heats the tunnel facing walls, and the tunnel facing walls thereby radiate heat into the shrink tunnel, the interior steam flow space including output openings;

steam pipes positioned at least partly within the shrink tunnel, each steam pipe extending along at least part of a length of the shrink tunnel, each steam pipe separated from the interior steam flow space by the tunnel facing walls, each steam pipe including steam ejection orifices for ejecting steam into the shrink tunnel; and a plurality of steam flow tubes, each steam flow tube connected to feed steam from one of the output openings of the interior steam flow space to one of the steam pipes, each steam flow tube running outside of the shrink tunnel;

wherein the interior steam flow space functions as a steam manifold through which steam progresses to reach the output openings.

13. The apparatus of claim 12, wherein the tunnel facing walls are maintained at 212° F. or above during shrink operations, and a pressure within the interior steam flow space is maintained at 1 psi or above during shrink operations.

14. The apparatus of claim 12, wherein the elongated steam chamber includes exterior walls spaced apart from the tunnel facing walls such that the interior steam flow space is defined between the exterior walls and the tunnel facing walls, wherein the output openings are located on at least one of the exterior walls, wherein each steam pipe includes an end portion outside of the shrink tunnel.

15. An apparatus for shrinking film onto products moving along a conveyance path, comprising:

an elongated steam chamber including an interior steam flow space along which steam travels, wherein the elongated steam chamber is shaped to form a shrink tunnel through which the conveyance path extends, wherein the elongated steam chamber includes at least one tunnel bounding wall that separates the interior steam flow space from the shrink tunnel, wherein the at least one tunnel bounding wall includes an inner surface facing and exposed to the shrink tunnel and an outer surface facing and exposed to the interior steam flow space, wherein a steam input is provided for flowing steam into the interior steam flow space, wherein steam traveling within the interior steam flow space and in contact with the outer surface of the at least one tunnel bounding wall heats the at least one tunnel bounding wall, and the at least one tunnel bounding wall thereby radiates heat into the shrink tunnel, the interior steam flow space including at least one outlet opening;

at least one steam header positioned at least partly within the shrink tunnel and extending along at least part of a length of the shrink tunnel, the steam header including steam ejection orifices for ejecting steam into the shrink tunnel; and at least one steam flow tube connected to feed steam from the at least one outlet opening of the interior steam flow space to the at least one steam header.

16. The apparatus of claim 15, wherein the at least one steam header comprises a first steam pipe.

17. The apparatus of claim 16 wherein the first steam pipe is mounted to permit tool-free rotation of the first steam pipe, for adjusting a directional output of the steam injection orifices.

* * * * *